US006092627A

United States Patent [19]

Burger

[11] Patent Number: 6,092,627

[45] Date of Patent: Jul. 25, 2000

[54] STOWABLE KNOCKDOWN SAWHORSE

[76] Inventor: Richard Burger, 572 Tamarack Drive, Qualicum Beach, British Columbia, Canada, V9K 1A7

[21] Appl. No.: 09/154,180

[22] Filed: Sep. 16, 1998

[51] Int. Cl.[7] ..... E04G 1/00; E04G 1/34; E04G 1/32

[52] U.S. Cl. ..... 182/165.5; 182/153; 182/225

[58] Field of Search ..... 182/186.5, 153–155, 182/225, 226, 181.1, 186.1, 186.2

[56] References Cited

U.S. PATENT DOCUMENTS

| | | | |
|---|---|---|---|
| 1,442,353 | 1/1923 | Merkle | 182/186.5 X |
| 1,819,252 | 8/1931 | Linsner | 182/153 |
| 3,289,789 | 12/1966 | Larson | 182/226 |
| 3,618,704 | 11/1971 | Smith | 182/155 |
| 4,640,386 | 2/1987 | Hall | 182/155 |
| 4,923,051 | 5/1990 | Newville . | |
| 5,102,078 | 4/1992 | Nordeng | 182/186.1 X |
| 5,257,829 | 11/1993 | Weeks . | |

*Primary Examiner*—Daniel P. Stodola
*Assistant Examiner*—Hugh B. Thompson
*Attorney, Agent, or Firm*—Christie, Parker & Hale, LLP

[57] ABSTRACT

A stowable knockdown sawhorse can be assembled in two configurations: an operating configuration and a storage configuration. The sawhorse includes a pair of inverted-V-shaped leg members and a saddle having four mounting assemblies—two at each end, one per side. Each leg member has a notched apex that envelops one end of the saddle and is in turn enveloped within an inclined channel formed within each mounting assembly, thereby forming the sawhorse into its operating configuration. Each mounting assembly further defines an exterior bearing surface, the bearing surfaces on like sides of the saddle facing and opposing each other and lying on planes that intersect beyond the saddle working surface to form an angle equal to the apex angle of the leg members. The bearing surfaces are thereby oriented to accept and retain therebetween the leg assemblies when disengaged from the ends of the saddle and inverted between the bearing surfaces to form the sawhorse into its storage configuration.

10 Claims, 4 Drawing Sheets

STOWABLE KNOCKDOWN SAWHORSE

FIELD

The present invention relates to sawhorses that can be disassembled when not in use. More particularly, it relates to sawhorses that can be reassembled into a second configuration for convenient transportation or storage.

BACKGROUND

A sawhorse is a useful tool for framers, carpenters, and many other trades, as well as for hobbyists, homeowners and gardeners. The sawhorse provides a simple yet effective working surface in the field and is particularly useful in pairs, although larger numbers are sometimes required. Function and ergonomics suggest that a sawhorse be approximately 30 inches tall, 30 inches long and 15 inches wide at its base. These factors combine to make sawhorses fairly bulky tools to transport or store.

Three main strategies have arisen to compensate for this bulkiness. Some people construct simple, disposable sawhorses at the job-site and abandon them when the job is finished. Others prefer sawhorses that are stackable and therefore somewhat easier to store and transport. Finally, others choose sawhorses that can be quickly disassembled or "knocked down" into their flat component parts. It is this last solution to which the present invention is directed.

Knockdown sawhorses are known to the art. Usually made of plywood or other sheet stock, they rely on simple dado joints and notches to attach legs to a horizontal beam (or "saddle"). When disassembled, most of these sawhorses become three or four independent flat parts which take up less space for storage or transportation than the assembled whole. However, a problem exists in that nothing holds the component parts together. Parts may go missing, resulting in frustration and work stoppages. Furthermore, a user carrying the parts to a job-site will have his hands full of loose parts slipping and sliding.

Two patents partially address this problem by providing components that can be assembled in a first configuration to form a functioning sawhorse and in a second, configuration to form a more compact and easily transportable package.

U.S. Pat. No. 4,923,051 issued on May 8, 1990 to Gerald E. Newville for a, "Collapsible Sawhorse," describes a sawhorse made up of three plywood parts: a saddle and two legs. The saddle is shaped as an elongated T, the crossbar providing a work surface and defining two parallel inverted-U-shaped channels, one against either side of the T-stem. When disassembled and packed for storage, the saddle is inverted and each leg is placed against one side of the saddle T-stem and inserted into one of the channel, friction retaining it snugly within. A handle cut in the saddle T-stem provides a means for carrying the device.

The major problem with this device is that the leg-retaining channels are subject to loosening over time as the sawhorse becomes worn from use. It is not unusual for the saddle of a sawhorse to become quite deeply scored by cutting operations. These cuts will weaken the channels and, where the saddle is not constructed as one integral whole, may even separate the saddle parts. Similarly, the screws or nails used to hold a multi-part saddle together are liable to be struck by a tool such as a saw, thereby damaging both saddle and tool.

U.S. Pat. No. 5,257,829 issued on Nov. 2, 1993 to Fred Weeks for a, "Sawhorse," discloses an alternative solution. The Weeks device comprises a saddle and two A-frame leg assemblies. The saddle is vertically grooved on both sides at each end to receive the leg assemblies and each leg assembly is notched at its apex to receive the saddle. A nut and bolt on each leg assembly allows the notch to be tightened, thereby gripping the saddle. Cross-bracing extends from the centroid of each leg assembly to the middle of the saddle for further stability.

To pack the sawhorse for storage, the two leg assemblies are placed parallel to each other, broad surface to broad surface, and the saddle is sandwiched between them, parallel to one of the legs. The bolt used for tensioning the cross-bracing is then passed through the centroids of both leg assemblies and tightened, holding all parts tightly together by friction. A latch mechanism acts as a physical barrier to prevent the saddle from falling out.

The main problem with the Weeks sawhorse is that it has too many parts. Machined bolts and nuts plus various hinge and latch mechanisms would make this product expensive. Some small parts might become loose and get lost resulting in frustration and lost productivity. The device is also too complicated to be quickly assembled and disassembled.

SUMMARY

What is needed is a cheap and simple sawhorse that can be knock downed and reassembled into a compact, secure package for convenient transportation and storage. The present invention is directed to such a device.

The present invention teaches a collapsible sawhorse having an operating configuration and a storage configuration. The sawhorse includes an elongated saddle and two independent inverted-V-shaped leg members. In the operating configuration, the saddle is supported at either end by a leg member, each leg member engaging one end of the saddle. In the storage configuration, the leg members are free from the ends of the saddle, being instead inverted to point toward the ground as V-shaped members and oriented broad face to broad face on either side of the saddle, retained in place by gravity and friction within two V-shaped channels on either side of the saddle.

In a preferred embodiment, the sawhorse includes a horizontal beam (or "saddle") and two supporting A-frame leg members that have notched apexes for receiving and retaining the saddle in operating configuration so that the working surface of the saddle faces away from the ground and is available for work. The saddle supports four mounting assemblies, two such assemblies at each end, one on either side. Each assembly defines an inclined channel, the channels located at like ends of the saddle being parallel and inclining toward the working surface from their end of the saddle to the far end. These channels are sized to receive and retain the notched apexes of the leg members in the operating configuration. Each mounting assembly further defines an external bearing surface, the bearing surfaces on like sides of the saddle opposing each other and lying on intersecting planes that meet beyond the working surface of the saddle to form an angle equal to the apex angle of the leg members. In storage configuration, the working surface of the saddle is faced toward the ground so that the bearing surfaces form a truncated V-shaped pocket into which the inverted leg members may be inserted for storage.

Therefore, according to one aspect of the invention there is provided for use in combination with first and second convex leg members to make a sawhorse having an operating configuration and a storage configuration, an apparatus comprising: an elongated saddle member having a first end, a second end, a work surface and a first side surface, the first end of the saddle being adapted to releasably engage or be releasably engaged by the first leg member proximate to its apex so as to direct the work surface away from the first leg member when in the operating configuration; and the second end of the saddle being adapted to releasably engage or be releasably engaged by the second leg member proximate to its apex so as to direct the work surface away from the second leg member when in the operating configuration; a first bearing surface normal to and abutting the first side surface, the first bearing surface being proximate to the first end of the saddle and facing the second end of the saddle; and a second bearing surface normal to and abutting the first side surface, the second bearing surface being proximate to the second end of the saddle and facing the first end of the saddle such that the planes on which the first and second bearing surfaces lie oppose each other and intersect to form an apex angle equal to the apex angle of the first leg member whereby in storage configuration the first leg member may be inserted apex first into the slot defined between the first and second bearing surfaces, to be retained therebetween broad side against the first side of the saddle.

Preferably, the intersecting planes intersect beyond the saddle and particularly beyond the work surface of the saddle. The first and second bearing surfaces might be at least partially recessed into the first side of the saddle or alternatively might at least partially extend beyond the first side of the saddle. In fact, the first and second bearing surfaces might be flanged.

It is desirable that the first leg member be inverted-V shaped, preferably A shaped. The apex of the first leg member can define a longitudinal notch adapted to receive and retain within the first end of the saddle. Similarly, the saddle might define a channel along its first side at its first end, the channel being inclined toward the saddle work surface toward its second end and being adapted to receive and retain within a portion of the notched apex of the first leg member. The channel might be at least partially recessed within the saddle or the channel might at least partially project from the saddle.

The saddle might further include a carrying surface opposite the work surface and a second side surface opposite the first side surface. It is desirable that a handle be affixed to the carrying surface are be formed as an integral portion of it.

Preferably, the saddle includes a third bearing surface normal to and abutting the second side surface, the third bearing surface being proximate to the first end of the saddle and facing the second end of the saddle; and a fourth bearing surface normal to and abutting the second side surface, the fourth bearing surface being proximate to the second end of the saddle and facing the first end of the saddle such that the planes on which the third and fourth bearing surfaces lie oppose each other and intersect to form an apex angle equal to the apex angle of the second leg member whereby in storage configuration the second leg member may be inserted apex first into the slot defined between the third and fourth bearing surfaces, to be retained therebetween broad side against the second side of the saddle.

The first and second leg members may be gussetted at their apex, and in such case, there might be included a first pair of complemental couplers, one so placed on each gusset that the first pair of complemental couplers engage each other when the first and second leg members are retained between the first and second bearing surfaces and the third and fourth bearing surfaces respectively.

There might further be included a second pair of complemental couplers, one so placed on each of the first side of the saddle and the broad side of the first leg member that the second pair of complemental couplers engage each other when the first leg member is retained between the first and second bearing surfaces.

There might be included a third pair of complemental couplers, one so placed on each cross-brace that the third pair of complemental couplers engage each other when the first and second leg members are retained between the first and second bearing surfaces and the third and fourth bearing surfaces respectively.

Preferably, the pairs of complemental couplers are formed from hook and loop material.

BRIEF DESCRIPTION OF THE DRAWINGS

These and other features, aspects, and advantages of the present invention will become better understood with reference to the following description, appended claims, and accompanying drawings where:

DESCRIPTION

Figure 1:
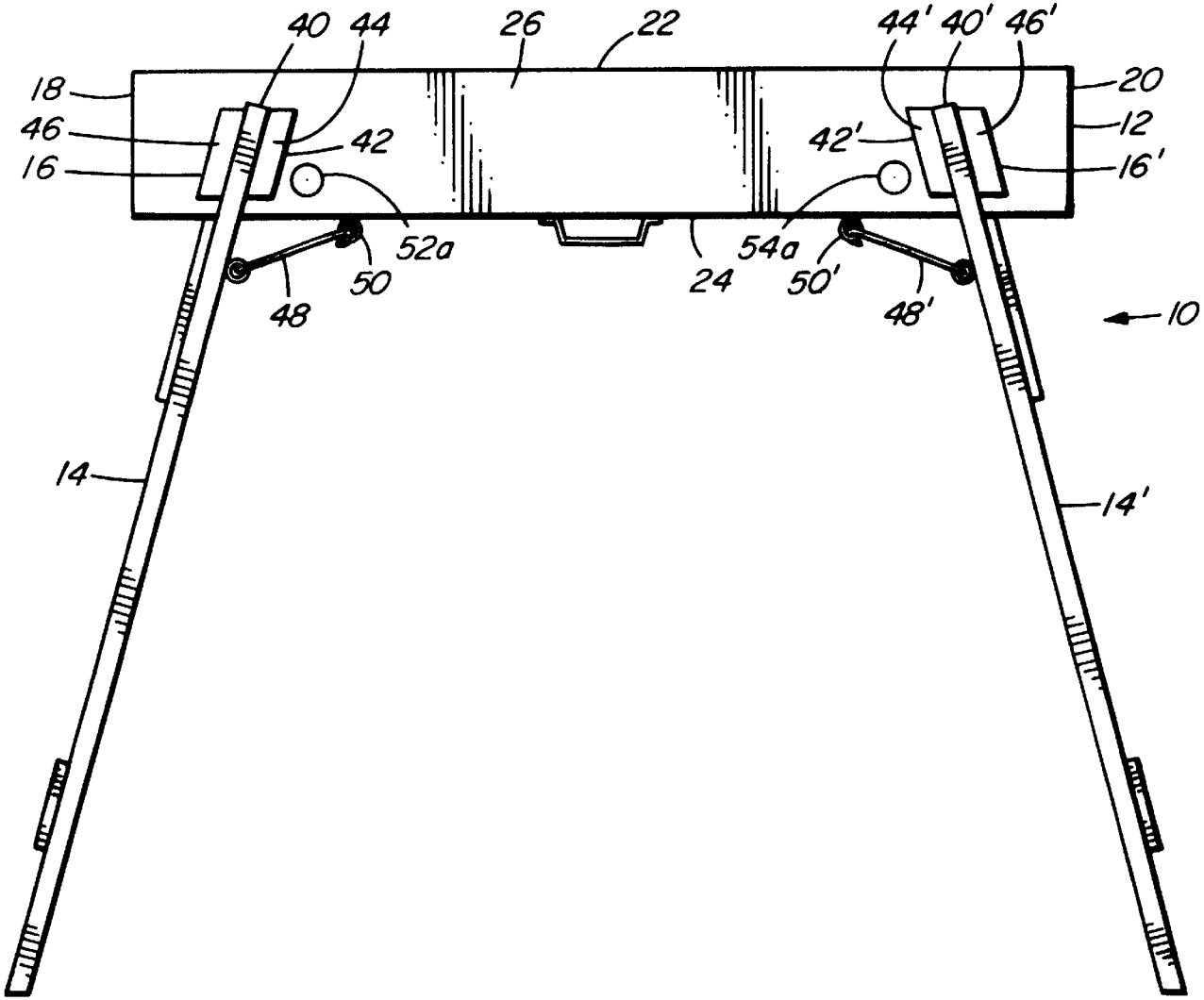
FIG. 1 is a side view of a sawhorse embodying one aspect of the present invention in operating configuration.

With reference now to FIG. 1, a sawhorse embodying one aspect of the invention is generally illustrated at 10. The sawhorse 10, which is here depicted in its operating configuration, is formed from an elongated saddle 12 supported by first and second leg members 14, 14' which engage the saddle via first and second mounting assemblies 16, 16'.

The saddle has first and second ends 18, 20, a working surface 22 that faces away from the ground in the operating configuration, a carrying surface 24 that faces toward the ground in the operating configuration, and first and second side surfaces (26, not shown). The saddle is approximately 30 inches long and may be made of standard 1"×5" lumber, oriented so that the thick five inch thickness spans between the working surface 22 and the carrying surface 24.

Figure 2:
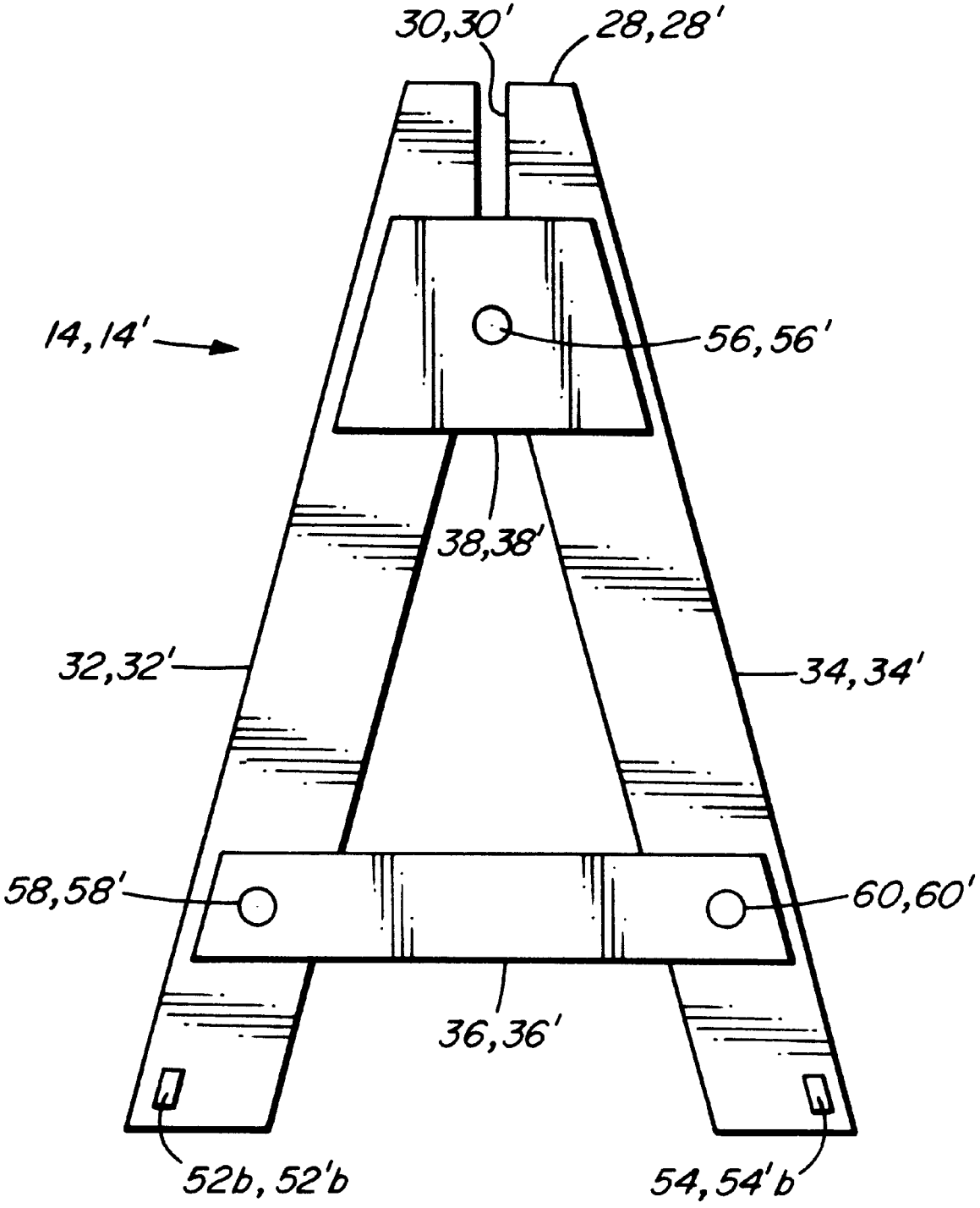
FIG. 2 is an end view of a leg from the sawhorse illustrated in FIG. 1.

With reference now to FIG. 2, one leg member 14, 14' is illustrated in greater detail. Each leg member 14, 14' has an inverted-V shape with an apex 28, 28' that defines a notch 30, 30'. As illustrated, the leg members 14, 14' are formed from opposing risers 32, 32', 34,34' that are linked by a cross-brace 36, 36' and a gusset 38, 38'. Each leg member 14, 14' may be built of lumber: 1"×4"s for the risers 32,32' 34,34' and plywood for the cross-bracing 36, 36' and the gusset 38, 38'. The cross-bracing 36, 36' joins the risers 32, 32', 34, 34' approximately four inches from the ground and the gusset 38, 38' reinforces the risers 32, 32', 34, 34' about three inches from their top. The gusset 38, 38' also serves to provide vertical support to the saddle 12. It has been found that an apex 28, 28' angle of 30 degrees contributes to good sawhorse 10 stability.

It should be noted that this construction is illustrative but not critical to the invention and many sorts of saddle 12 and leg member 14, 14' would suffice. In particular, it is envisioned that each of these components 12, 14, 14', 36, 36', 38, 38' could be manufactured in one or more pieces from plastic.

Figure 3:
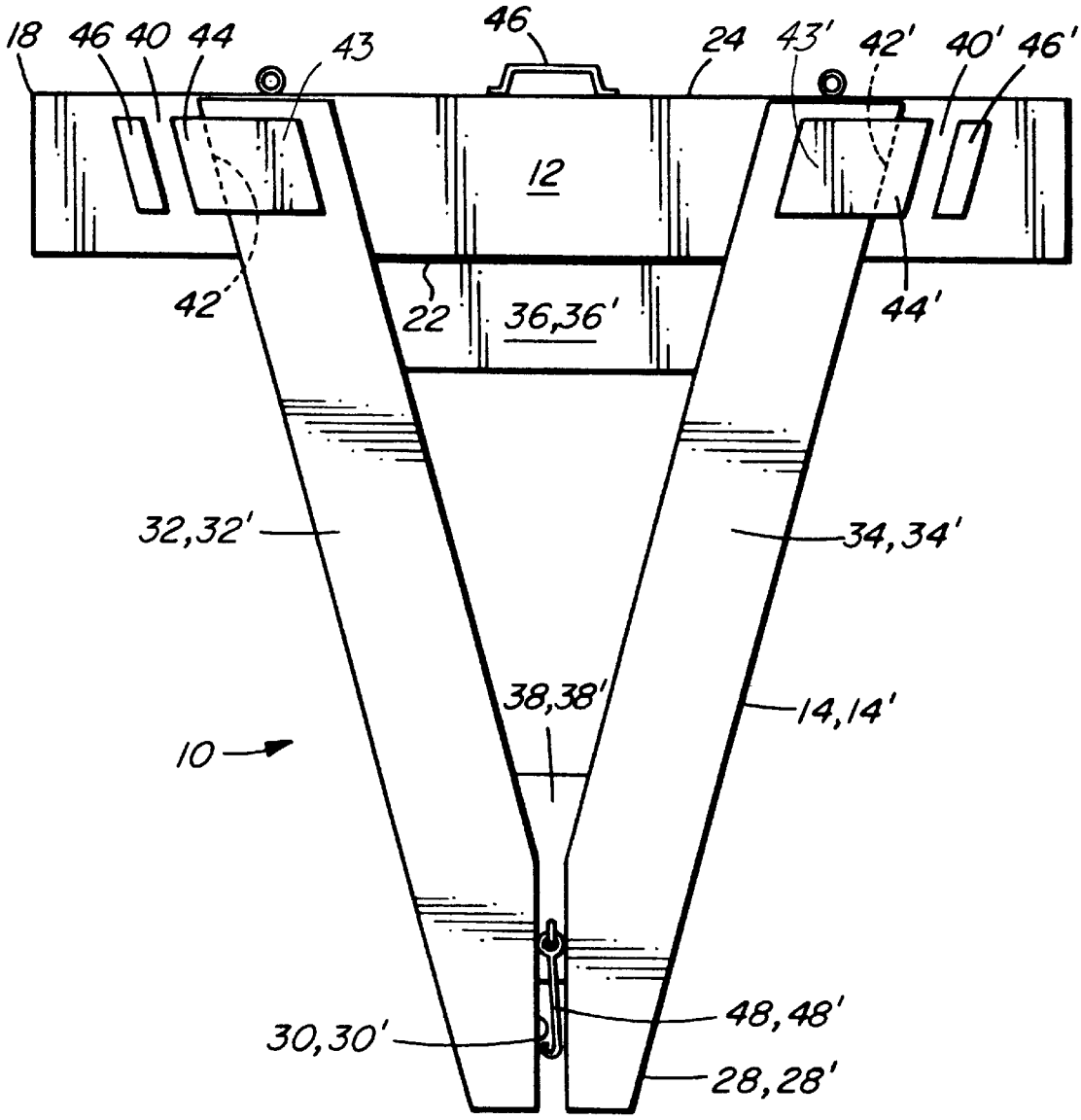
FIG. 3 is a side view of the sawhorse illustrated in FIG. 1 in storage configuration.

With reference now to FIGS. 1 and 3 the mounting assemblies 16, 16' will be described in further detail. There are two key features embodied in the mounting assemblies 16, 16'. In the operating configuration (FIG. 1), the mounting assemblies 16, 16' retain the leg members 14, 14' at a suitable orientation to the saddle 10 to form a stable sawhorse 10. In the storage configuration (FIG. 3), they retain the inverted leg members 14, 14' broad side against the side 26 of the saddle 12. It will be seen that the leg members 14, 14' are retained within inclined channels 40, 40' in the operating configuration (FIG. 1) and retained within a truncated V-slot sandwiched between two bearing surfaces 42, 42' in the storage configuration. It should be understood that there are identical inclined channels and bearing surfaces (not shown) on the far side of the saddle 12 (not illustrated).

The channels 40, 40' at each end 18, 20 of the saddle 12 are inclined towards the working surface 22 toward the far end 20, 18 of the saddle 12. It has been found that a 75 degree angle formed between the channel 40, 40' and the ground provides a suitable oriented leg assembly 14, 14' and reasonable sawhorse 10 stability in the operating configuration.

Each mounting assembly 16, 16' may be formed from a pair of opposing fingers 44, 44', 46, 46' that are so arranged as to ensure the channel 40, 40' is appropriately oriented and sufficiently wide to accept and snugly retain the leg members 14, 14'. The fingers may be 1"×1" strips attached to the saddle 12 by means of glue, screws, nails, staples or other suitable fasteners. Two pairs are placed at each end of the saddle, on opposite sides. Each pair of strips defines a raised channel whose width is slightly greater than the thickness of the A-frame material.

Figure 4:
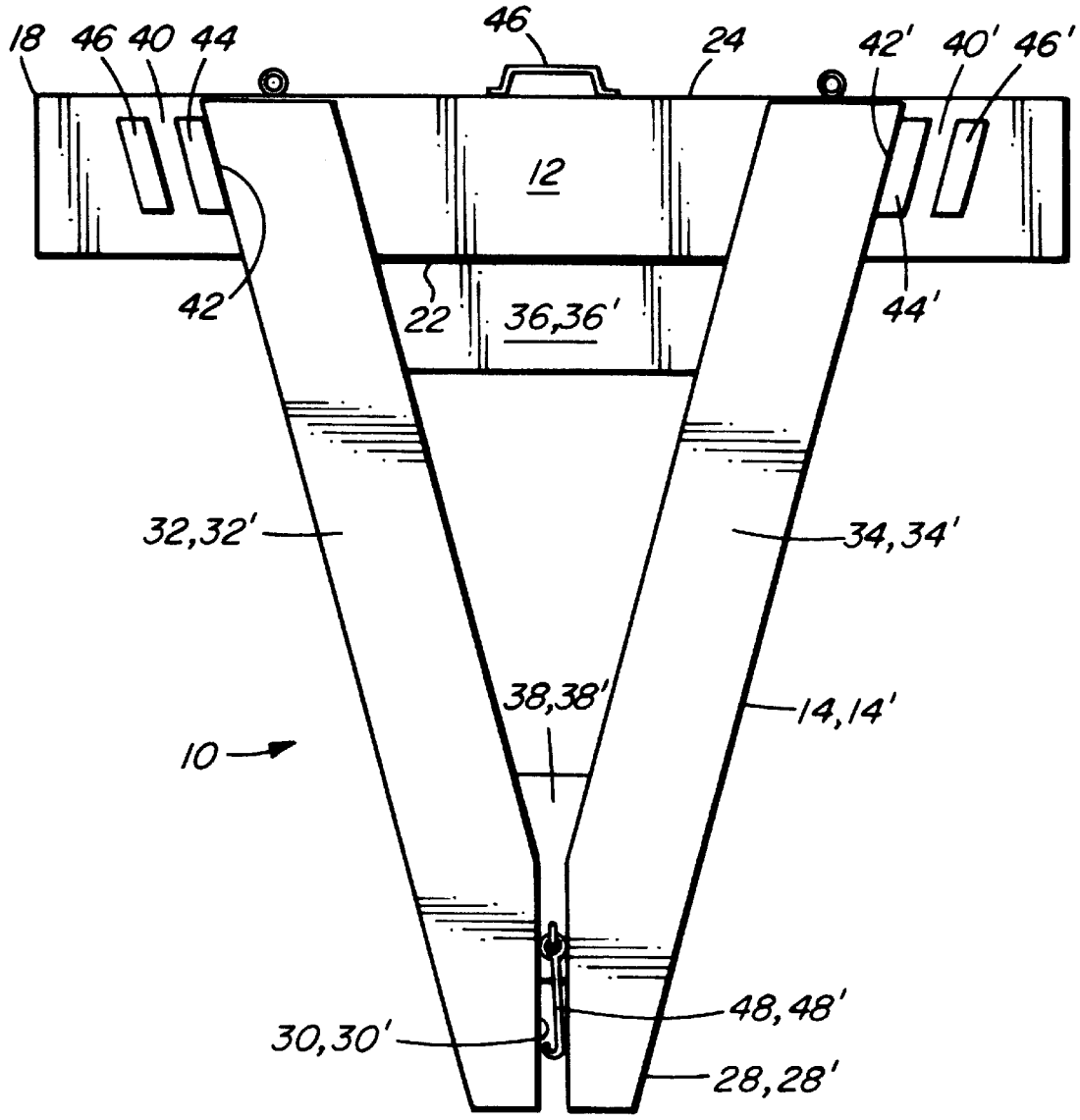
FIG. 4 is an alternative embodiment of the sawhorse illustrated in FIG. 3.

On each side (26, not shown) of the saddle 12, the pair of mounting assemblies 16, 16' are arranged so that the bearing surfaces 42, 42' oppose each other and form between them a truncated inverted-V-shaped slot. The bearing surfaces 42, 42' lie on planes that intersect beyond the working surface 22 of the saddle 12 to define an angle equal to the apex angle 28, 28' of the leg members 14, 14'. In the storage configuration with the saddle 12 inverted so that the carrying surface 24 faces away from the ground, the bearing surfaces 42, 42' form between them a truncated V-shaped slot adapted to receive and retain the inverted leg members 14, 14' for storage. It should be noted that, as shown in FIG. 3, the bearing surfaces 42, 42' could be channelled or otherwise overhung 43, 43' to even better retain the leg members 14, 14'. FIG. 4 illustrates an alternative embodiment of the sawhorse wherein the bearing surfaces 42, 42' are not overhung.

Additional hardware may be added to make the sawhorse 10 easier to use in either configuration. A handle 46 on the carrying surface 24 of the saddle 12 doesn't interfere with the working surface 22 but helps transport the stowed sawhorse 10. Hook fasteners 48, 48' on the leg assemblies 14, 14' and cooperating eye fasteners 50, 50' on the carrying surface 24 of the saddle 12 help retain the sawhorse 10 in its working configuration (FIG. 1) while the eye fasteners 50, 50' can be used to secure the sawhorse 10 in storage configuration (FIG. 3), serving as a fastening point for pegboard fasteners, rope, and the like.

Cooperating fasteners such as hook and loop fasteners **52*a*, 52*b*, 52'*b*, 54*a*, 54*b*, 54'*b*, 56, 56', 58, 58', 60, 60' releasably secure the leg members 14, 14' to each other and to the saddle 12 in storage configuration. It will be noted that the plywood for the cross-brace 36, 36' and the gusset 38, 38' is approximately one half of the thickness of the saddle, about 5/16ths or 3/8ths of an inch. When the leg members 14, 14' are placed on either side of the saddle for storage, the cross-brace 36, 36' and the gusset 38, 38' of one leg member 14, 14' will just contact that of the other, and the cooperating fasteners placed on the cross-braces 36, 36' and the gussets 38, 38'** will engage.

In operation the user carries the sawhorse 10 to the job-site in its storage configuration (FIG. 3) using the handle 46. He then disengages the cooperating fasteners **52*a*, 52*b*, 52'*b*, 54*a*, 54*b*, 54'*b*, 56, 56', 58, 58', 60, 60' that fasten the leg members 14, 14' to each other and to the saddle 12. To put the sawhorse 10 in its operating configuration (FIG. 1), he rotates the saddle 12 so that the working surface 22** faces away from the ground.

He then slides the ends 18, 20 of the saddle 12 into the apex notches 30, 30' of the leg members 14, 14' and the apex notches 30, 30' into the channels 40, 40' of the mounting assemblies 16, 16'. The leg assemblies 14, 14' are thereby snugly engaged to the saddle 12 and the sawhorse 10 is ready for use.

To stow the sawhorse 10, the leg members 14, 14' are disengaged from the saddle 12 and the mounting assemblies 16, 16'. The saddle 12 is then inverted so that the carrying surface 24 faces away from the ground and the bearing surfaces 42, 42' on each side of the saddle (26, not shown) form a truncated V-shaped slot for receiving and retaining the inverted leg members 14, 14'. The leg members 14, 14' are inverted and inserted into the truncated V-shaped slots in the saddle 12 and the complemental couplers **52*a*, 52*b*, 52'*b*, 54*a*, 54*b*, 54'*b*, 56, 56', 58, 58', 60, 60'** are engaged.

Although a specific embodiment of the present invention has been described and illustrated, the present invention is not limited to the features of this embodiment, but includes all variations and modifications within the scope of the claims.

For example, it is envisioned that the bearing surfaces 42, 42' do not need to be an integral part of the channel 40, 40' defining mechanism 44, 44', 46, 46'.

It is also envisioned that the bearing surfaces 42, 42' might oriented such that the working surface 22 and the carrying surface 24 are identical.

It is still further envisioned that the leg members 14, 14' need not be v-shaped but may be any convex or planoconvex shape.

What is claimed is:

1. A sawhorse kit, comprising:

a) first and second leg members, each leg member having a foot end and an apex end, each leg member tapering from the foot end to the apex end to form an apex angle having a vertex, the apex end defining a notch at the vertex;

b) an elongated saddle having a first end, a second end opposite the first end, an upper working surface extending between the first and second ends, a first side surface adjacent to the working surface, and a second side surface opposite the first side surface, the first and second ends of the saddle being adapted to be received within the notch in the first and second leg members respectively, and c) first and second mounting assemblies respectively located proximate to the first and second ends of the saddle, each mounting assembly having:

i) a channel on each of the first and second side surfaces that cooperates to receive the apex end of one of the first and second leg members in an operating configuration; and ii) a first bearing surface on the first side surface, and a second bearing surface on the second side surface;

d) the first bearing surfaces of the first and second mounting assemblies defining a slot therebetween, the second bearing surfaces of the first and second mounting assemblies defining a slot therebetween, wherein each slot tapers toward the saddle working surface at an angle substantially equal to the apex angle and retains the foot ends of the first and second leg members when the leg members are stored in an alternative storage configuration;

wherein in the operating configuration the apex end of the respective first and second leg members is received within the channels of the respective first and second mounting assemblies and the respective first and second ends of the saddle are received within the notch of the respective first and second leg members.

2. A sawhorse kit as claimed in claim 1, wherein the bearing surface of at least one of the first and second mounting assemblies is flanged.

3. A sawhorse kit as claimed in claim 2, wherein each leg member includes:

a) a first riser, having an apex end and a foot end;

b) a second riser, having an apex end and a foot end, the second riser being disposed obliquely to the first riser so as to define with the first riser the apex angle; and c) a gusset engaging the first and second risers proximate to their respective apex ends, to retain the first and second risers in fixed disposition and to define with the first and second risers the notch.

4. A sawhorse kit as claimed in claim 3, wherein the leg member further includes a cross-brace engaging the first and second risers proximate to their respective foot ends.

5. A sawhorse kit as claimed in claim 3, wherein each mounting assembly includes:

i) an elongated first finger on each of the first and second side surfaces; and ii) an elongated second finger spaced apart from the first finger, the second finger including the bearing surface, the bearing surface facing away from the first finger and wherein the first and second fingers define therebetween the channel.

6. A sawhorse kit as claimed in claim 5, a) wherein the saddle further includes a carrying surface opposite the working surface; and b) further including a handle located at the carrying surface of the saddle.

7. A sawhorse kit, comprising:

a) first and second leg members, each leg member having a foot end and an apex end, each leg member tapering from the foot end to the apex end to form an apex angle having a vertex, the apex end defining a notch at the vertex;

b) an elongated saddle having a first end, a second end opposite the first end, an upper working surface extending between the first and second ends, a first side surface adjacent to the working surface, and a second side surface opposite the first side surface, the first and second ends of the saddle being adapted to be received within the notch in the first and second leg members respectively, c) first and second mounting assemblies respectively located proximate to the first and second ends of the saddle, each mounting assembly having:

i) a channel on each of the first and second side surfaces that cooperates to receive the apex end of one of the first and second leg members in an operating configuration; and ii) a first bearing surface on the first side surface, and a second bearing surface on the second side surface;

d) the first bearing surfaces of the first and second mounting assemblies defining a first slot therebetween, and the second bearing surfaces of the first and second mounting assemblies defining a second slot therebetween, wherein each slot tapers toward the saddle working surface at an angle substantially equal to the apex angle and retains the foot ends of the first and second leg members when the leg members are stored in an alternative storage configuration;

wherein in the operating configuration the apex end of the respective first and second leg members is received within the channels of the respective first and second mounting assemblies and the respective first and second ends of the saddle are received within the notch of the respective first and second leg members;

e) wherein the bearing surface of at least one of the mounting assemblies is flanged;

f) wherein each leg member further includes:

i) a first riser, having an apex end and a foot end;

ii) a second riser, having an apex end and a foot end, the second riser being disposed obliquely to the first riser so as to define with the first riser the apex angle;

iii) a gusset engaging the first and second risers proximate to their respective apex ends, to retain the first and second risers in fixed disposition and to define with the first and second risers the notch; and iv) a cross-brace engaging the first and second risers proximate to their respective foot ends; and g) and second leg members, such that the first and second complemental couplers engage when the first and second leg members are retained within the first and second tapered slots respectively, in the storage configuration.

8. A sawhorse kit as claimed in claim 7, further including third and fourth complemental couplers, fixed to the cross-brace of the respective first and second leg members, such that the third and fourth complemental couplers engage when the first and second leg members are retained within the first and second tapered slots respectively, in the storage configuration.

9. A sawhorse kit as claimed in claim 8, further including fifth and sixth complemental couplers, respectively fixed to the foot end of one of the first and second leg members and one of the first and second side surfaces of the saddle, such that the fifth and six complemental couplers engage when the one of the first and second leg members is retained within one of the first and second tapered slots, in the storage configuration.

10. A sawhorse kit as claimed in claim 9, further including seventh and eighth complemental couplers, the seventh complemental coupler being fixed to the gusset of one of the first and second leg members and the eighth complemental coupler being fixed to the carrying surface of the saddle, such that the seventh and eighth complemental couplers engage when the one of the first and second leg members is retained within the channel of one of the first and second mounting assemblies, in the operating configuration.

* * * * *